US007796095B2

(12) United States Patent
Glen

(10) Patent No.: US 7,796,095 B2
(45) Date of Patent: Sep. 14, 2010

(54) DISPLAY SPECIFIC IMAGE PROCESSING IN AN INTEGRATED CIRCUIT

(75) Inventor: David I. J. Glen, Toronto (CA)

(73) Assignee: ATI Technologies ULC, Markham, Ontario (CA)

( * ) Notice: Subject to any disclaimer, the term of this patent is extended or adjusted under 35 U.S.C. 154(b) by 1023 days.

(21) Appl. No.: 10/907,070

(22) Filed: Mar. 18, 2005

(65) Prior Publication Data

US 2006/0208960 A1 Sep. 21, 2006

(51) Int. Cl.
*G09G 5/00* (2006.01)

(52) U.S. Cl. ..... 345/3.1; 345/561

(58) Field of Classification Search ..... 345/3.1, 345/541, 545, 546, 547, 552, 561, 600; 348/739
See application file for complete search history.

(56) References Cited

U.S. PATENT DOCUMENTS 5,748,250 A * 5/1998 Markandey et al. ..... 348/451
5,774,134 A 6/1998 Saito
5,838,389 A 11/1998 Mical et al.
6,452,579 B1 * 9/2002 Itoh et al. ..... 345/100
6,937,232 B2 * 8/2005 Lin et al. ..... 345/204
7,138,989 B2 * 11/2006 Mendelson et al. ..... 345/204
7,262,818 B2 * 8/2007 Chuang et al. ..... 348/790
7,277,076 B2 * 10/2007 Shiomi et al. ..... 345/89
2003/0137527 A1 7/2003 Lin et al.

OTHER PUBLICATIONS

Baba, Masahiro et al.; "9-1: Software Processed Level-Adaptive Overdrive (SLAO) Method for Multi-Media LCDs with YUV Video Data"; EURODISPLAY 2002; Kanagawa, Japan; pp. 155-158.
International Search Report from European Patent Office dated Sep. 4, 2006, for International Application No. PCT/IB2006/000784, pp. 1-12.

* cited by examiner

*Primary Examiner*—Richard Hjerpe
*Assistant Examiner*—Tom V Sheng
(74) *Attorney, Agent, or Firm*—Vedder Price P.C.

(57) ABSTRACT

An image processing circuit, such as a graphics accelerator chip or any other suitable circuit, includes display output control logic that is operative to receive a current frame of information from a frame buffer and is operative to process a current frame, such as by providing gamma correction, image scaling, graphics or video overlaying, or other suitable processing, to produce a processed current display frame and stores the processed current display frame back in the frame buffer. Fixed function or dedicated, display type specific temporal processing logic receives the processed current display frame stored in the frame buffer and also obtains at least one previous processed current display frame from the frame buffer and temporally processes pixels from each of the processed current display frame and the previous processed current display frame to produce a temporally compensated display frame for a specific type of display.

28 Claims, 3 Drawing Sheets

DISPLAY SPECIFIC IMAGE PROCESSING IN AN INTEGRATED CIRCUIT

FIELD OF THE INVENTION

The invention relates generally to image processing systems and methods, and more particularly to image processing systems and methods for providing images to different types of displays.

BACKGROUND OF THE INVENTION

Image processing systems are known which may include for example, when implemented in the form of a laptop computer or handheld device, a central processing unit and graphics accelerator (e.g. graphics co-processor) and frame buffer memory that stores image frames of data that are displayed on a display screen. Many types of display devices require image processing to convert the image data from industry standard formats to the format required by the specific display technology. For example, LCD displays may require gamma correction, color temperature adjustment, dithering, scaling, edge enhancement, frame rate conversion, deinterlacing of interlaced fields or frames and pixel intensity overdrive compensation to reduce pixel switching times, among other processes. Plasma displays may require other specific operations and other types of displays may require yet other operations. For example, digital light projection (DLP) televisions, LCD displays for televisions, plasma displays for televisions and other display types attempt to emulate the exact properties of a cathode ray tube (CRT) but they not are cathode ray tubes and as such require additional image processing that is specific to the display type.

Image processing operations may require a frame (or more than one frame) of storage of previous image data. For example, frame rate conversion, deinterlacing, and pixel intensity overdrive compensation to reduce pixel switching times may require the use of a current image frame and previous image frames. Another class of image processing may need only image data from a current frame to produce its output. Currently some of the display systems that perform the second class of operations (no frame storage) are done either in a graphics co-processor before sending the image over a display interface, such as dithering, while others are done in specialized electronics integrated within the display unit.

Typically, frame storage operations that require the storage of one or more frames of previous image data are not performed on the graphics accelerator side of the display interface but are typically performed by specialized electronics that are integrated within the display unit and may include for example another frame buffer and image processor because each type of display unit may need to perform different types of display specific operations. These operations may require relatively expensive electronics in the display device itself.

Graphics co-processors are known to provide temporal processing such as field deinterlacing for interlaced television signals. However, such processing occurs prior to any display specific processing and is display type independent.

Graphics co-processors are also known to provide scaling, gamma correction, and dithering operations on information which typically does not require retrieving of information from a frame buffer and is typically done prior to sending to the display device that then has its own internal logic and frame buffer for providing display type specific processing.

As such, it would be desirable to provide an image processing system that eliminated or reduced the need for use of a frame buffer in the display unit and eliminate or reduce the need for such processing to be present in the display device so that relatively expensive electronics in the display may be reduced or eliminated.

DETAILED DESCRIPTION OF THE PREFERRED EMBODIMENT

Figure 1:
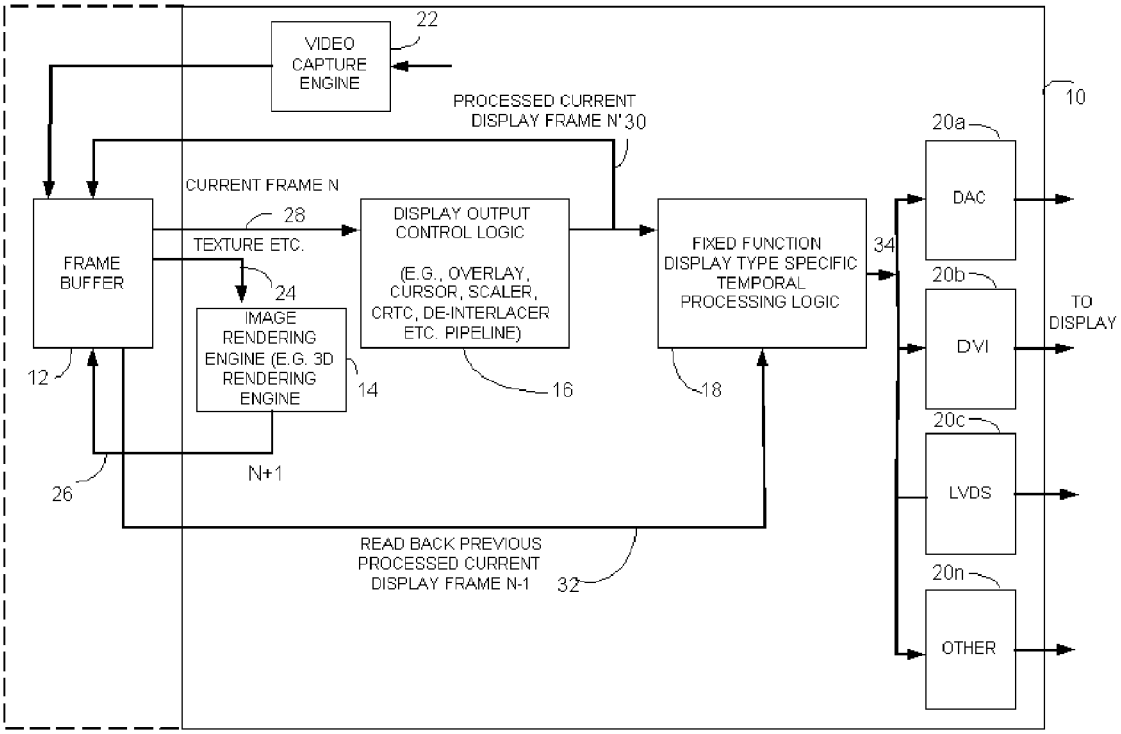
FIG. 1 is a block diagram illustrating one example of a graphics processing circuit in accordance with one embodiment of the invention.

Briefly, an image processing circuit, such as a graphics accelerator chip or any other suitable circuit, includes display output control logic that is operative to receive a current frame of information from a frame buffer and is operative to process a current frame, such as by providing gamma correction, image scaling, graphics or video overlaying, or other suitable processing, to produce a processed current display frame and stores the processed current display frame back in the frame buffer. Fixed function or dedicated, display type specific temporal processing logic receives the processed current display frame stored in the frame buffer and also obtains at least one previous processed current display frame from the frame buffer and temporally processes pixels from each of the processed current display frame and the previous processed current display frame to produce a temporally compensated display frame for a specific type of display.

The fixed function display type specific temporal processing logic may carry out for example, frame rate conversion and/or deinterlacing using pixels from each of the current and previous processed current display frames. The temporally compensated display frame is then ready for display by a specific display type such as an LCD, DLP display, plasma display, or any other suitable display device.

In another embodiment, the temporal processing logic includes overdrive compensation logic that is operative to overdrive pixel intensities of one or more pixels of the temporally compensated display frame to facilitate improved pixel switching times for an LCD display device. In addition, in one embodiment the graphics processing circuit is an integrated graphics co-processor chip that may be suitably linked with another processor, such as a host CPU or other suitable processing device as desired.

The image processing circuit may also include an image rendering engine, such as a 2D or 3D graphics rendering engine, that generates display frames for storage in the frame buffer.

The display output control logic preferably implements standard display controller side processing that is common to all display types that do not require a reference to the previous frame. As applied to digital light projection specific displays, the fixed function display type specific temporal processing logic may provide motion compensated bit sequential dithering. The logic may be customized to provide any suitable display specific process that requires a previous frame store.

Among other advantages, the use of fixed function display type specific temporal processing logic in a graphics processing circuit relieves the 3D graphics rendering engine of such processing so that the performance of 3D rendering is not unnecessarily affected. The fixed function display type specific temporal processing logic serves as a type of dedicated logic dedicated for the purpose of temporally processing image frames that have been processed to include, for example, display independent enhancements, that have been stored in a common frame buffer. By effectively reusing the frame buffer that is already used for graphic processing purposes, to provide temporal processing of processed frames to produce temporally compensated display frames for a specific type of display effectively removes the need for a frame buffer in a display unit and the corresponding logic in the display device. Other advantages will also be recognized by those having ordinary skill in the art.

FIG. 1 is a block diagram illustrating one example of an image processing circuit 10, such as a graphics co-processor integrated circuit (e.g. IC) or any suitable discreet logic or other suitable structure as desired. The image processing circuit 10 may optionally include an integrated frame buffer 12 as indicated by dashed lines or it may be external to the image processing circuit 10 as desired. The image processing circuit 10 includes an image rendering engine 14 such as, but not limited to, a 2D or 3D graphics rendering engine, display output logic 16 and fixed function display type specific temporal processing logic 18 as well as a plurality of specific and different display interfaces 20*a*-20*n* for each particular type of display interface that can be connected to the circuit 10. For example, the different display interfaces 20*a*-20*n*, as known in the art may provide suitable interconnect to a digital video interface (DVI), LVDS, digital analog converter (DAC) or other suitable display specific interface as known in the art.

The image processing circuit 10 may also include other conventional graphics processing logic including for example video capture engines 22 and other suitable video and/or graphics processing logic as known in the art. The engines and logic as described herein may be implemented in any suitable manner, including, but not limited to processors, state machines, discreet logic, any suitable combination of hardware, software and firmware, or any other suitable structure as desired. The image rendering engine 14 may be a conventional 3D graphics rendering engine as known in the art which may for example use texture information 24 stored in the frame buffer 12 or any other suitable information and render a subsequent display frame 26 (N+1). The 3D engine stores the subsequent frame 26 in the frame buffer 12 for display on one of a plurality of display devices coupled to the graphics processing circuit 10.

The display output control logic 16 receives a current frame of information 28 (N) that has been stored in the frame buffer 12 by the video capture engine 22, the image rendering engine 14, or by any other suitable source. The display output control logic 16 processes the current frame 28 to produce a processed current display frame 30 designated N' and, in this example, writes back the processed current display frame 30 to the frame buffer 12 for storage. The entire frame may be written back or a portion of the processed current display frame may be written back and stored in the frame buffer 12 as desired. The processed current display frame 30 is also received by the fixed function display type specific processing logic 18 either as output from the display output control logic 16 or may be read or otherwise retrieved from the frame buffer 12 as desired. The fixed function display type specific processing logic 18 also obtains at least one previous processed current display frame 32 which may be for example previous in time with respect to the processed current display frame N', from the same frame buffer 12.

The fixed function display type specific processing logic 18 temporally processes at least a portion of pixels from each of the processed current display 30 and pixels from the previous processed current display frame 32 which has been read back from the frame buffer to produce a temporally compensated display frame 34 which has been temporally compensated for a specific type of display device, such as specifically temporally compensated for an LCD display, a DLP display device, a plasma display device, or other non-CRT display device. As such, the frame buffer 12 is shared by the display output control logic 16 and the dedicated or fixed function display type specific processing logic 18. The fixed function display type specific processing logic 18 as noted above may be for example a fixed function processor suitably programmed to carry out temporal processing, for example on a pixel by pixel basis, from the processed current display frame 30 and the read back previous processed current display frame 32 to produce the temporally compensated display frame 34. In this embodiment, the fixed function display type specific temporal processing logic 18 is independent from the image rendering engine 14 and is dedicated logic or fixed function logic dedicated to temporally processing multiple display frames for a specific type of display.

In this example, the current display frame 28 is processed by the display output control logic 16 in a way that is independent of the type of display that is to display the image frames. For example, examples of this processing may include gamma correction or temporal correction. The display output control logic 16 may do pixel processing that is either dependent or independent of display type but if dependent on display type the processing done does not require previous or future frame information. For example, the display output control logic 16 may read a frame buffer display surface, such as the current frame 28 and perform pixel reformatting to format pixels in a suitable format for a display interface type and may also provide, if desired, gamma correction, frame scaling, graphics and/or video overlay generation or any other suitable processing as desired other than temporal processing that is specific to a display type. Pixel reformatting may include converting 16 bpp to 24 or 30 bpp for a display interface and may also unpack information into separate R, G and B components.

Also in this example, the display output control logic 16 includes logic operative to read the current frame 28 from the frame buffer. The display output control logic 16 may be for example a display pipeline and may include for example, as noted above, overlay generation, cursor generation, scalers, display timing generator, deinterlacing logic for interlaced video or any other suitable processing as known in the art.

The fixed function display type specific temporal processing logic 18 performs its display specific processing on frames that have already been processed by logic 16 and ready for display but that require display device specific temporal processing that includes the use of at least a multiple frames of image information. Preferably, although not required, the temporal processing is performed on a pixel by pixel basis for a set of frames. The fixed function display type specific temporal processing logic is operative to output the temporally compensated display frame to at least one (or more) of the plurality of display interfaces (20*a*-20*n*).

Since the fixed function display type specific temporal processing logic 18 needs to perform, perhaps, different temporal processing depending on the different type of display device that is receiving image frames from the graphics processing circuit 10, different temporal processing logic may be activated depending upon the type of display device being coupled to receive the image frames. Selection methods could be plug and play. For example, EDID information could be used or having a suitable file for each display type and a user can select a suitable file, or any other suitable method may be used. For example the fixed function display type specific temporal processing logic 18 may be controlled through a suitable control register or registers in the graphics circuits 10 or external to the circuit 10 that for example, contain display type identification data that indicates which one of the plurality of different desired display types is to receive the image information and hence which temporal processing logic is to be activated. In one example, a software driver identifies the type of display by some suitable method as noted above and configures hardware registers appropriately.

For example, where the control register indicates that the display device is an LCD display device, the fixed function display type specific temporal processing logic includes and hence activates overdrive compensation logic that is operative to overdrive pixel intensities of one or more pixels to facilitate improved pixel switching times for the LCD display device. Also overdrive parameters will depend on physical properties of a specific LCD panel. If the type of display device is indicated to be a plasma display device, the fixed function display type specific temporal processing logic is selected to provide motion compensation to reduce artifacts and moving images for example since the plasma pixel elements in the plasma display device may take time to change and hence motion compensation may be desirable. For example, plasma or DLPs are sequential color display technologies with fast switch times, but not all three colors are visible at once and can create image artifacts.

The display type identification data may be set in the control register by any Suitable manner, such as by a user through a graphic user interface (GUI), a keyboard, or any suitable interface and may also be plug and play with the software driver. The frame buffer 12, as known in the art, may be an SDRAM, VDRAM element or any suitable frame buffer configuration (e.g. IC or portion thereof).

The fixed function display type specific temporal processing logic 18 is dedicated to providing temporal processing using a plurality of display frames that have been preprocessed by the display output control logic 16 and are temporally processed in a manner that is display device specific thereby eliminating the need for a frame buffer to be located in the display device and associated electronic circuitry to carry out display specific processing.

Figure 2:
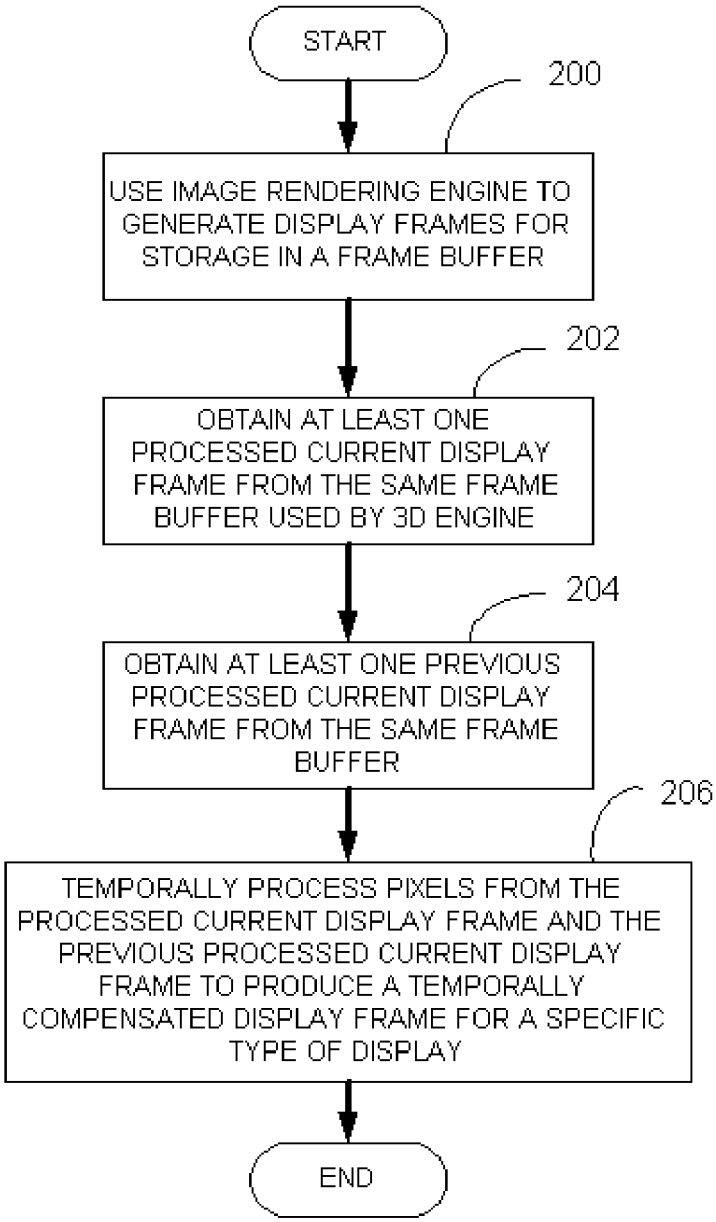
FIG. 2 is a flowchart illustrating one example of a method for providing display specific compensated images for a particular type of display in accordance with one embodiment of the invention.

FIG. 2 illustrates one example of a method for providing display specific compensated images for a particular type of display that may be carried out for example by the graphics processing circuit 10 in FIG. 1 or any other suitable logic or combination of processor or processors. As shown in block 200, the method includes, if desired, using at least an image rendering engine to generate display frames for storage in a frame buffer. However, it will be recognized that the display frame can come from any suitable source. As shown in block 202, the method includes obtaining, such as by the fixed function display type specific temporal processing logic, at least one processed current display frame 30 from the same frame buffer 12 used by the 3D graphics rendering engine. It will be understood that the processed current display frame 30 may be a video frame, for example, provided by a video capture engine or other source if desired and not a display frame generated by 3D graphics rendering engine. As shown in block 204, the method includes obtaining, such as by the fixed function display type specific temporal processing logic 18, at least one previous processed current display frame 32 from the same buffer 12 that also contains the processed current display frame 30.

As shown in block 206, the method includes temporally processing, such as by the fixed function display type specific temporal processing logic 18, at least a portion of pixels from each of the processed current display frame 30 and at least pixels from the previous processed current display frame 32 obtained from the same frame buffer, for one of a plurality of particular display devices to produce a temporally compensated display frame 34 for a specific type of display. As such the produced temporally compensated display frame 34 is effectively ready for display by a display device without requiring any further display type specific processing. The method includes out putting the temporally compensates display frame to one or more of the different display interfaces 20. The method then continues as desired to produce image frames for displaying on a specific display device at a rate suitable for a particular display device.

In an alternative embodiment, the fixed function display type specific temporal processing logic 18 may temporally process the pixels from each of the processed current display frame and the previous processed current display frame obtained from the same frame buffer 12 in a parallel processing manner so that no write back of the processed current display frame by the display output control logic is necessary. To implement this embodiment, the fixed function display type specific temporal processing logic. The display output control logic 16 is duplicated. One set would read current frame N (28) and the other logic would read unprocessed frame N-1 from the frame buffer and saves write back of frame 32.

Figure 3:
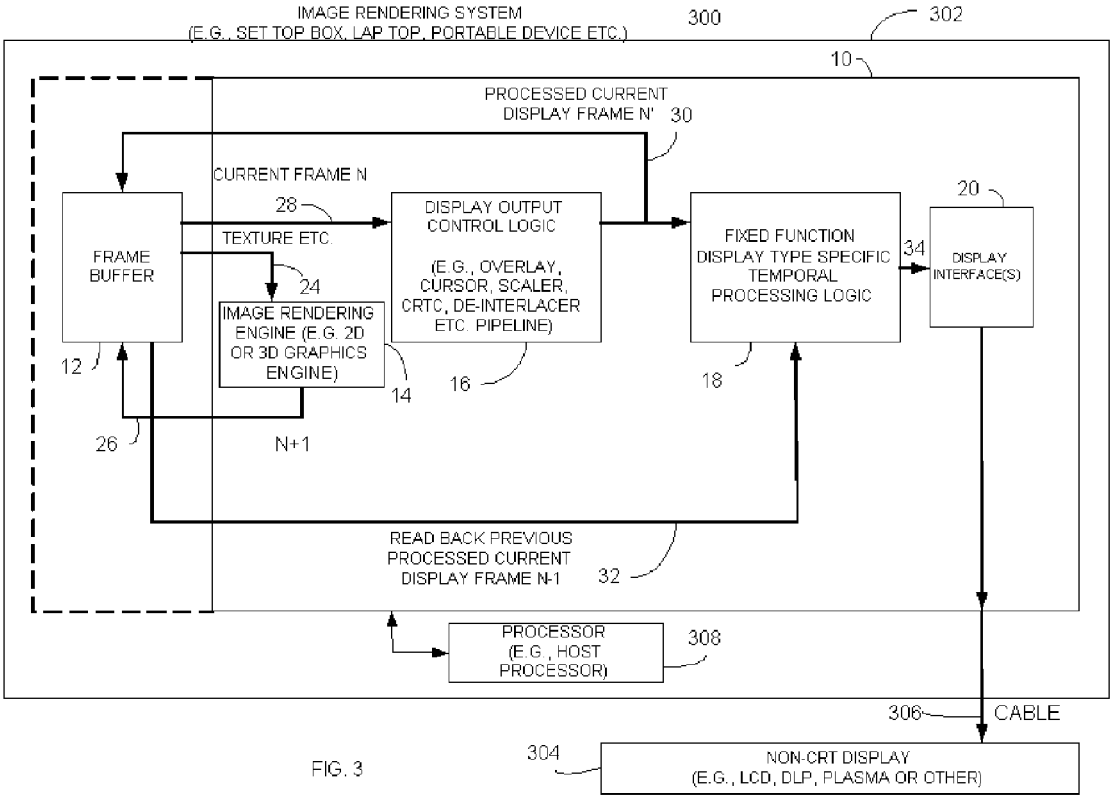
FIG. 3 is a block diagram illustrating one example of a display system in accordance with one embodiment of the invention.

FIG. 3 is a block diagram illustrating one example of an image display system 300 that includes an image rendering system 302 such as a cable set top box, satellite set top box, laptop computer or other suitable portable device and a non-CRT display device 304 that visually displays image frames provided by the image rendering system 302 over a cable 306 or other wireless link. The image rendering system 302 may include, in addition to the graphics processing circuit 10, a processor 308, such as a host processor that may allow the execution of software applications and other functionality as known in the art. The non-CRT display 304 need not include an additional frame buffer or fixed function display type specific temporal processing logic since it is incorporated in the image rendering system 302. As previously noted, the fixed function display type specific temporal processing logic 18 occurs in sequence after the display output control logic performs processing of a display frame or after processing that may or may not be independent of the type of non-CRT display being used.

For example, the non-CRT display may be a DLP, LCD, plasma or other type of display and may be manufactured at a lower cost since the image rendering system 302 reuses the frame buffer present in a system that employs 3D graphics rendering engine 24. As such, one benefit of the above system is that it can replace relatively expensive display side electronics and a frame buffer with much less expensive electronics on the graphics co-processor side. For example, since the graphics co-processor already has a frame buffer the additional costs for the fixed function display type specific temporal processing logic may be relatively low.

The above detailed description of the invention and the examples described therein have been presented for the purposes of illustration and description only and not by limitation. It is therefore contemplated that the present invention cover any and all modifications, variations or equivalents that fall within the spirit and scope of the basic underlying principles disclosed above and claimed herein.

What is claimed is:

1. An image processing circuit comprising:

display output control logic operative to receive a current frame of information for display and operative to process the current frame to produce a processed current display frame; and fixed function display type specific temporal processing logic, operatively coupled to the display output logic to receive the processed current display frame and operative to obtain at least one previous processed current display frame and operative to temporally process at least a portion of pixels from each of the current and the at least one previous processed current display frame to produce a temporally compensated display frame for a specific type of display technology, wherein the fixed function display type specific temporal processing logic is operatively responsive to display technology type identification data that indicates one of a plurality of different desired display technology types.

2. The image processing circuit of claim 1 including the frame buffer and wherein the display output control logic includes logic operative to read the current frame from the frame buffer and to perform pixel reformatting for a particular display interface type.

3. The image processing circuit of claim 1 wherein the display output control logic is operative to provide at least one of: gamma correction, image scaling, color correction and graphics or video overlaying.

4. The image processing circuit of claim 1 wherein the fixed function display type specific temporal processing logic includes overdrive compensation logic operative to overdrive pixel intensity of one or more pixels to facilitate improved pixel switching times for at least one of an LCD display device, a DLP display device and a plasma display device.

5. The image processing circuit of claim 1 wherein the display output control logic includes logic operative to provide at least one of frame rate conversion and de-interlacing using the at least portion of pixels from each of the processed current display frame and the at least one previous processed current display frame.

6. The image processing circuit of claim 1 including an image rendering engine operative to generate display frames for storage in the frame buffer and wherein the image rendering engine comprises at least one of a two dimensional and a three dimensional graphics rendering engine.

7. The image processing circuit of claim 1 wherein the fixed function display type specific temporal processing logic is operatively coupled to a plurality of display interfaces and operative to output the temporally compensated display frame to at least one of the plurality of display interfaces.

8. The image processing circuit of claim 1, in which the display output control logic is operative to store at least a portion of the processed current display frame to a frame buffer.

9. An image processing circuit comprising:

fixed function display type specific temporal processing logic operative to receive a processed current display frame and operative to obtain at least one previous processed current display frame from a same frame buffer and operative to temporally process at least a portion of pixels from each of the processed current display frame and the at least one previous processed current display frame in a parallel processing manner to produce a temporally compensated display frame for a specific type of display technology, wherein the fixed function display type specific temporal processing logic is operatively responsive to display technology type identification data that indicates one of a plurality of different desired display technology types.

10. The image processing circuit of claim 9 including the frame buffer and display output control logic that includes logic operative to read the current frame from the frame buffer and to perform pixel reformatting for a particular display interface type.

11. The image processing circuit of claim 10 wherein the display output control logic is operative to provide at least one of: gamma correction, image scaling, color correction and graphics or video overlaying.

12. The image processing circuit of claim 9 wherein the fixed function display type specific temporal processing logic includes overdrive compensation logic operative to overdrive pixel intensity of one or more pixels to facilitate improved pixel switching times for at least one of an LCD display device, a DLP display device and a plasma display device.

13. The image processing circuit of claim 9 wherein the display output control logic includes logic operative to provide at least one of frame rate conversion and de-interlacing using the at least portion of pixels from each of the current and the at least one previous processed current display frame.

14. The image processing circuit of claim 9 including an image rendering engine operative to generate display frames for storage in the frame buffer and wherein the image rendering engine comprises at least one of a two dimensional and a three dimensional graphics rendering engine.

15. The image processing circuit of claim 9 wherein the fixed function display type specific temporal processing logic is operatively coupled to a plurality of display interfaces and operative to output the temporally compensated display frame to at least one of the plurality of display interfaces.

16. The image processing circuit of claim 9, wherein the display output control logic is operative to receive a current frame of information for display and is operative to process the current frame to produce a processed current display frame.

17. A method for providing display specific compensated images for a particular type of display comprising:

obtaining at least one processed current display frame from a same frame buffer used by an image rendering engine;

obtaining at least one previous processed current display frame from the same frame buffer; and temporally processing at least a portion of pixels from each of the processed current display frame and the at least one previous processed current display frame from the frame buffer for one of a plurality of particular display types to produce a temporally compensated display frame for a specific type of display technology, in response to display technology type identification data that indicates one of a plurality of different desired display technology types.

18. The method of claim 17 wherein temporally processing at least a portion of pixels from each of the current and the at least one previous processed current display frame from the frame buffer for one of a plurality of particular display types includes overdriving a pixel intensity of one or more pixels to facilitate improved pixel switching times for at least one of an LCD display device, a DLP display device and a plasma display device.

19. The method of claim 17 including providing at least one of: gamma correction, image scaling, color correction and graphics or video overlaying prior to temporally processing at least a portion of pixels from each of the current and the at least one previous processed current display frame from the frame buffer for one of a plurality of particular display types.

20. The method of claim 17 including outputting the temporally compensated display frame to at least one of the plurality of display interfaces.

21. An image processing circuit comprising:

fixed function logic operative to temporally process at least a portion of pixels from each of a processed current display frame and at least one previous processed current display frame to produce a temporally compensated display frame for a specific type of display technology in response to a detected display technology type; and a frame buffer; wherein the fixed function logic is operative to receive the processed current display frame and operative to obtain the at least one previous processed current display frame both from the frame buffer and wherein the detected display technology type is based on display technology type identification data that indicates one of a plurality of different desired display technology types.

22. The image processing circuit of claim 21 wherein the fixed function logic includes overdrive compensation logic operative to overdrive pixel intensity of one or more pixels to facilitate improved pixel switching times for at least one of: an LCD display device, a DLP display device and a plasma display device.

23. The image processing circuit of claim 22 wherein the fixed function logic is operatively coupled to a plurality of display interfaces and operative to output the temporally compensated display frame to at least one of the plurality of display interfaces.

24. A method for providing display specific compensated images for a particular type of display comprising:

obtaining at least one processed current display frame from a same frame buffer used by an image rendering engine;

obtaining at least one previous processed current display frame from the same frame buffer;

detecting a display technology type of one or more displays and temporally processing at least a portion of pixels from each of the processed current display frame and the at least one previous processed current display frame from the frame buffer for one of a plurality of particular display types to produce a temporally compensated display frame for a specific type of display technology based on a detected display technology type.

25. The method of claim 24 wherein temporally processing at least a portion of pixels from each of the current and the at least one previous processed current display frame from the frame buffer for one of a plurality of particular display types includes overdriving a pixel intensity of one or more pixels to facilitate improved pixel switching times for at least one of an LCD display device, a DLP display device and a plasma display device.

26. The method of claim 25 including providing at least one of: gamma correction, image scaling, color correction and graphics or video overlaying prior to temporally processing at least a portion of pixels from each of the current and the at least one previous processed current display frame from the frame buffer for one of a plurality of particular display types.

27. The method of claim 25 including outputting the temporally compensated display frame to at least one of the plurality of display interfaces.

28. The method of claim 24 wherein detecting the display technology type is based on display technology type identification data that indicates one of a plurality of different desired display technology types.

* * * * *